US007145932B2

(12) United States Patent
Sakaguchi et al.

(10) Patent No.: US 7,145,932 B2
(45) Date of Patent: Dec. 5, 2006

(54) ELECTRIC FURNACE

(75) Inventors: Isao Sakaguchi, Tokyo (JP); Tadayoshi Tanaka, Tokyo (JP)

(73) Assignee: Sakaguchi Dennetsu Kabushiki Kaisha, Tokyo (JP)

( * ) Notice: Subject to any disclaimer, the term of this patent is extended or adjusted under 35 U.S.C. 154(b) by 70 days.

(21) Appl. No.: 11/020,445

(22) Filed: Dec. 22, 2004

(65) Prior Publication Data

US 2005/0141586 A1 Jun. 30, 2005

(30) Foreign Application Priority Data

Dec. 25, 2003 (JP) ..... 2003-429991
Jan. 29, 2004 (JP) ..... 2004-021200

(51) Int. Cl.
*H05B 3/62* (2006.01)

(52) U.S. Cl. ..... 373/119; 373/127; 219/406

(58) Field of Classification Search ..... 373/5, 373/109, 117–119, 127–134; 219/390–391, 219/406–408, 420, 424, 536
See application file for complete search history.

(56) References Cited

U.S. PATENT DOCUMENTS 2,463,329 A * 3/1949 Stansbury ..... 219/424
3,786,162 A * 1/1974 Colson ..... 373/119
4,106,179 A * 8/1978 Bleckmann ..... 219/536

FOREIGN PATENT DOCUMENTS

JP 07183238 7/1995

* cited by examiner

*Primary Examiner*—Tu Hoang
(74) *Attorney, Agent, or Firm*—Boyle Fredrickson Newholm Stein & Gratz S.C.

(57) ABSTRACT

An electric furnace has a furnace wall, a cylindrical spiral member made of a wire of heat resistant material, a part of the cylindrical portion of which being embedded into the furnace wall and the remaining cylindrical portion of which being projected from an inner surface of the furnace wall, and a heating member inserted into the remaining cylindrical portion of the spiral member. The wire is wound along circles, ellipses, triangles, or quadrangles. The heating member has a circular, quadrangular, triangular or elliptical cross section.

40 Claims, 6 Drawing Sheets

PRIOR ART

ELECTRIC FURNACE

BACKGROUND OF THE INVENTION

1. Field of the Invention

The present invention relates to an electric furnace and, more particular, relates to an electric furnace which holds easily and positively a heating member with small heat loss.

2. Description of the Related Art

Japanese Patent Application Laid-Open No. 183238/1995 discloses a supporting structure of a heating member for an electric furnace.

FIG. 12 shows a perspective view of a portion of the conventional electric furnace a portion of which being cut away.

FIG. 13 shows a perspective view of a portion of the electric furnace shown in FIG. 12.

A reference numeral 1 denotes a heat insulating cylindrical furnace wall, 2 denotes a heater of an electric resistance wire wound helically along an inner peripheral surface of the heat insulating cylindrical furnace wall 1, 3 denotes a plurality of wire supporting member fixed on the inner peripheral surface of the furnace wall so as to separate with a predetermined space to one another in the circumference direction of the furnace wall, 4 denotes a hole formed in the wire supporting member 3, through which the electric resistance wire is passed. The wire supporting member 3 has a trapezoidal cross section tapering to one side facing the center of the furnace.

In the conventional electric furnace mentioned-above, a contact area of the heat wire 2 passing through the hole 4 with respect to the wire supporting member 3 becomes smaller than that in case of a wire supporting member having a rectangular cross section, so that an area of exposed portion of the heat wire 2 and a generating heat quantity become larger therefore, and that it is possible to reduce the heat radiation loss due to the wire supporting member 3.

However, in the electric furnace mentioned-above the reduction of the heat radiation loss is still insufficient.

OBJECT AND SUMMARY OF THE INVENTION

The present invention has been made in view of the foregoing problems.

Accordingly, it is an object of the present invention to provide an electric furnace comprising a furnace wall, a cylindrical spiral member made of a wire of heat resistant material, a part of the cylindrical portion of which being embedded into the furnace wall and the remaining cylindrical portion of which being projected from an inner surface of the furnace wall, and a heating member inserted into the remaining cylindrical portion of the spiral member.

It is anther object of the present invention to provide an electric furnace wherein the wire is wound along circles, ellipses, or quadrangles.

It is a further object of the present invention to provide an electric furnace comprising a furnace wall, a cylindrical spiral member made of a wire of heat resistant material, at least a half portion of the cylindrical spiral member being embedded into the furnace wall and the remaining semicylindrical portion of which being projected from an inner surface of the furnace wall, and a heating member inserted into the remaining semicylindrical portion of the spiral member.

A side surface portion of the heating member is embedded into the furnace wall. The heating member has a circular, quadrangular, triangular or elliptical cross section.

Other objects, features, and advantages of the invention will become apparent to those skilled in the art from the following detailed description and accompanying drawings. It should be understood, however, that the detailed description and specific examples, while indicating the preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings in which like reference numerals represent like parts throughout, and in which.

DETAILED DESCRIPTION OF THE PREFERRED EMBODIMENTS

Embodiment 1

Figure 1:
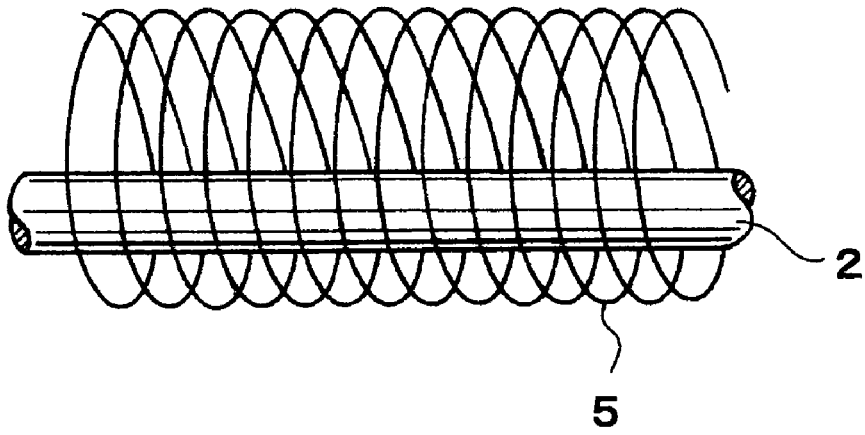
FIG. 1 is perspective view of a spiral member and a heating member for use in an electric furnace in accordance with a preferred embodiment of the present invention.
Figure 2:
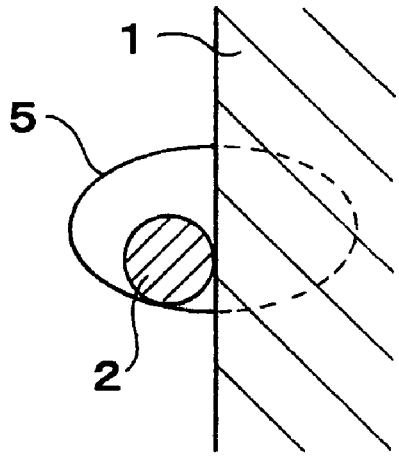
FIG. 2 is vertically sectioned side view of an essential portion of the electric furnace shown in FIG. 1.

According to the present invention as shown in FIG. 1 and FIG. 2, a cylindrical spiral member 5 is made of a wire of heat resistant material wound along ellipses, a part of the cylindrical portion of the cylindrical spiral member 5 is embedded into a heat insulating furnace wall 1 made of a ceramics fiber, a remaining cylindrical portion of the cylindrical spiral member 5 is projected from an inner surface of the furnace wall 1, and a heating member 2 of rod shape made of electric resistant material is inserted into the cylindrical spiral member 5 and held thereby.

In the above embodiment of the present invention, the heating member 2 can be held positively with low cost by the cylindrical spiral member 5 made of the wire of heat resistant material. Specifically, the contact area of the heating member 2 with respect to the cylindrical spiral member 5 is small, so that the heat radiation of the heating member 2 becomes large and the partial over heat of the heating member 2 can be prevented, and that the service life of the heating member 2 can be prolonged.

Further, the heating member 2 can be held suitably by varying a diameter of the wire forming the cylindrical spiral member 5, a diameter of the cylindrical spiral member 5, and/or a winding pitch of the wire, while enhancing the heat efficiency.

Figure 5:
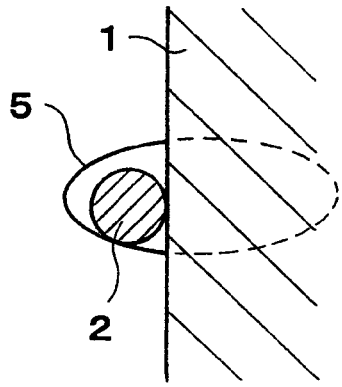
FIG. 5 is a vertically sectioned side view of an essential portion of an electric furnace in accordance with yet further embodiment of the present invention.

It is preferable that at least a half portion of the cylindrical spiral member 5 is embedded into the furnace wall 1, in order to held positively the cylindrical spiral member 5 by the furnace wall 1, as shown in FIG. 5.

Figure 3:
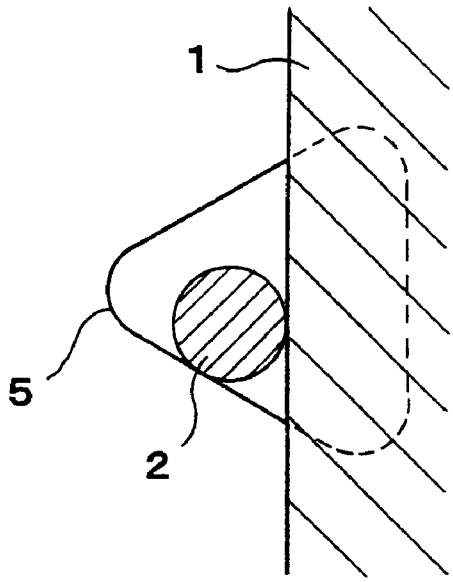
FIG. 3 is vertically sectioned side view of an essential portion of an electric furnace in accordance with an another embodiment of the present invention.
Figure 4:
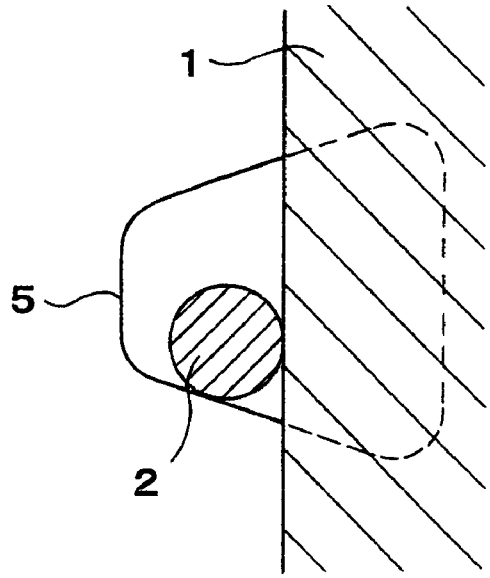
FIG. 4 is a vertically sectioned side view of an essential portion of an electric furnace in accordance with a further embodiment of the present invention.
Figure 8:
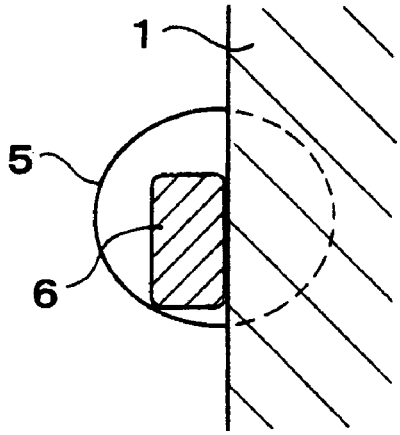
FIG. 8 is a vertically sectioned side view of an essential portion of an electric furnace in accordance with an another embodiment of the present invention.

Instead of the cylindrical spiral member 5 made of the wire wound along ellipses, a cylindrical spiral member 5 made of the wire wound along circles, triangles or quadrangles, such as trapezoids may be used, as shown in FIG. 8, FIG. 3 or FIG. 4, respectively.

Embodiment 2

Figure 6:
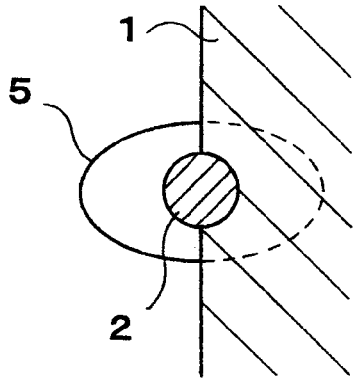
FIG. 6 is a vertically sectioned side view of an essential portion of an electric furnace in accordance with still another embodiment of the present invention.

In an embodiment 2 of the present invention, a side surface portion of the heating member 2 is embedded into the furnace wall 1 without being held by the cylindrical spiral member 5, as shown in FIG. 6.

In this embodiment, the heat generating quantity of the heating member 2 can be adjusted by adjusting the volume of the heating member 2 to be embedded into the furnace wall 1.

Figure 7:
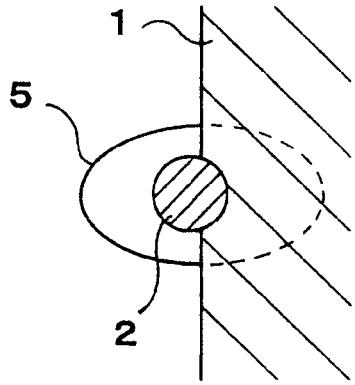
FIG. 7 is a vertically sectioned side view of an essential portion of an electric furnace in accordance with still further embodiment of the present invention.

It is preferable that the heating member 2 is embedded into the furnace wall 1 so as to be exposed more than about one half portion of the cross section of the heating member 2 in the furnace core, as shown in FIG. 7, in order to increase the heat radiation area of the heating member 2 and to enhance the heating efficiency.

Embodiment 3

In an embodiment 3 of the present invention, as shown in FIG. 8, a heating member 6 of rectangle having a long side and a short side in cross section is used instead of the heating member 2 in the embodiments 1 and 2, and is inserted into the cylindrical spiral member 5 and held thereby so that the long side surface of the heating member 6 is faced to the core center of the furnace.

In this embodiment, the heat radiation area facing a work (not shown) arranged in the core center of the furnace can be increased and the heating efficiency of the heating member 6 can be enhanced.

It is possible to vary the heating efficiency of the heating member 6 with respect to the work to be heated, if the ratio of the length of the long side of the heating wire 6 with respect to the length of the short side of the heating wire 6 is varied. For example, the heating efficiency can be enhanced, if the length of the long side is increased and the length of the short side is decreased.

Figure 9:
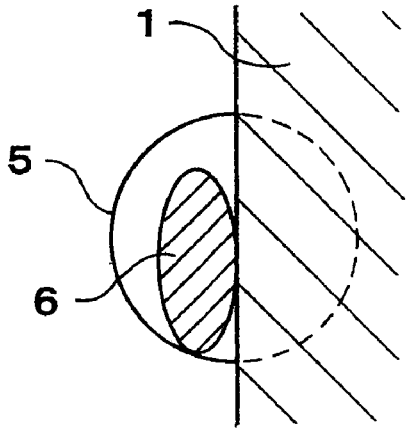
FIG. 9 is a vertically sectioned side view of an essential portion of an electric furnace in accordance with an another embodiment of the present invention.
Figure 10:
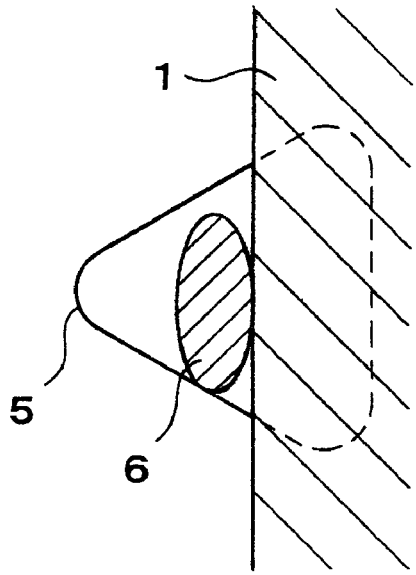
FIG. 10 is a vertically sectioned side view of an essential portion of an electric furnace in accordance with an another embodiment of the present invention.
Figure 11:
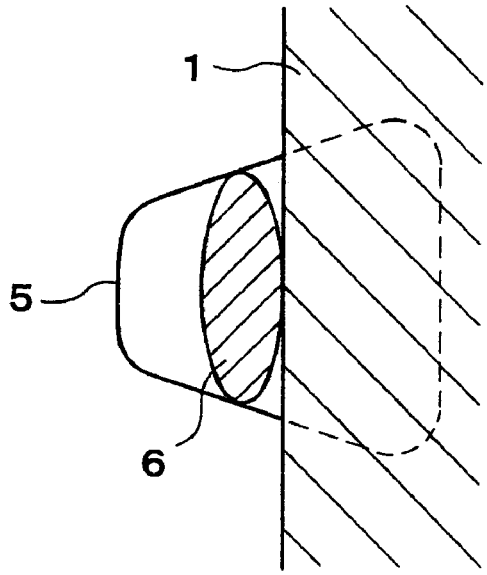
FIG. 11 is a vertically sectioned side view of an essential portion of an electric furnace in accordance with an another embodiment of the present invention.
Figure 12:
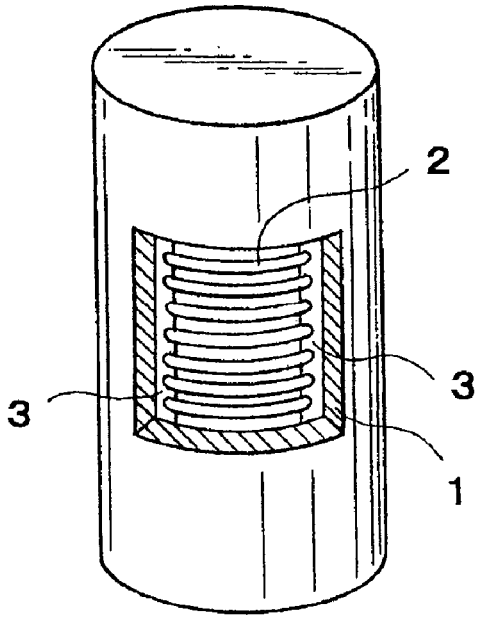
FIG. 12, appropriately labeled "PRIOR ART," shows a perspective view of a portion of a conventional electric furnace a portion of which being cut away.
Figure 13:
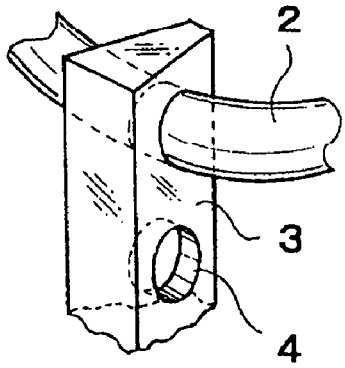
PRIOR ART FIG. 13
FIG. 13. appropriately labeled "PRIOR ART." shows a perspective view of a portion of the electric furnace shown in FIG. 12.

The cross section of the heating member 6 may be changed from the rectangle to an ellipse, as shown in FIG. 9 to FIG. 11, or a triangle (not shown).

According to the present invention, the heating member can be held positively with low cost by the spiral member made of the wire, and the contact area of the heating member with respect to the spiral member is small, so that the heat radiation of the heating member becomes large and the partial over heat of the heating member can be prevented, and that the service life of the heating member can be prolonged. Further, the heating member can be held suitably by varying the diameter and the winding pitch of the wire forming the cylindrical spiral member, or the diameter of the cylindrical spiral member, so as to enhance the heat efficiency.

While the invention has been particularly shown and described with reference to the preferred embodiments thereof, it will be understood by those skilled in the art that various changes in form and details may be made therein without departing from the spirit and scope of the invention as defined by the appended claims.

I claim:

1. An electric furnace comprising a furnace wall, a cylindrical spiral member made of a wire of heat resistant material, a part of the cylindrical portion of which being embedded into the furnace wall and the remaining cylindrical portion of which being projected from an inner surface of the furnace wall, and a heating member inserted into the remaining cylindrical portion of the spiral member.

2. The electric furnace as claimed in claim 1, wherein the wire is wound along circles.

3. The electric furnace as claimed in claim 1, wherein the wire is wound along ellipses.

4. The electric furnace as claimed in claim 1, wherein the wire is wound along triangles.

5. The electric furnace as claimed in claim 1, wherein the wire is wound along quadrangles.

6. An electric furnace comprising a furnace wall, a cylindrical spiral member made of a wire of heat resistant material, at least a half portion of the cylindrical spiral member being embedded into the furnace wall and the remaining semicylindrical portion of which being projected from an inner surface of the furnace wall, and a heating member inserted into the remaining semicylindrical portion of the spiral member.

7. The electric furnace as claimed in claim 6, wherein the wire is wound along circles.

8. The electric furnace as claimed in claim 6, wherein the wire is wound along ellipses.

9. The electric furnace as claimed in claim 6, wherein the wire is wound along triangles.

10. The electric furnace as claimed in claim 6, wherein the wire is wound along quadrangles.

11. The electric furnace as claimed in claim 1, wherein a side surface portion of the heating member is embedded into the furnace wall.

12. The electric furnace as claimed in claim 2, wherein a side surface portion of the heating member is embedded into the furnace wall.

13. The electric furnace as claimed in claim 3, wherein a side surface portion of the heating member is embedded into the furnace wall.

14. The electric furnace as claimed in claim 4, wherein a side surface portion of the heating member is embedded into the furnace wall.

15. The electric furnace as claimed in claim 5, wherein a side surface portion of the heating member is embedded into the furnace wall.

16. The electric furnace as claimed in claim 6, wherein a side surface portion of the heating member is embedded into the furnace wall.

17. The electric furnace as claimed in claim 1, wherein the heating member has a circular cross section.

18. The electric furnace as claimed in claim 2, wherein the heating member has a circular cross section.

19. The electric furnace as claimed in claim 3, wherein the heating member has a circular cross section.

20. The electric furnace as claimed in claim 4, wherein the heating member has a circular cross section.

21. The electric furnace as claimed in claim 5, wherein the heating member has a circular cross section.

22. The electric furnace as claimed in claim 6, wherein the heating member has a circular cross section.

23. The electric furnace as claimed in claim 1, wherein the heating member has a quadrangular cross section.

24. The electric furnace as claimed in claim 2, wherein the heating member has a quadrangular cross section.

25. The electric furnace as claimed in claim 3, wherein the heating member has a quadrangular cross section.

26. The electric furnace as claimed in claim 4, wherein the heating member has a quadrangular cross section.

27. The electric furnace as claimed in claim 5, wherein the heating member has a quadrangular cross section.

28. The electric furnace as claimed in claim 6, wherein the heating member has a quadrangular cross section.

29. The electric furnace as claimed in claim 1, wherein the heating member has a triangular cross section.

30. The electric furnace as claimed in claim 2, wherein the heating member has a triangular cross section.

31. The electric furnace as claimed in claim 3, wherein the heating member has a triangular cross section.

32. The electric furnace as claimed in claim 4, wherein the heating member has a triangular cross section.

33. The electric furnace as claimed in claim 5, wherein the heating member has a triangular cross section.

34. The electric furnace as claimed in claim 6, wherein the heating member has a triangular cross section.

35. The electric furnace as claimed in claim 1, wherein the heating member has an elliptical cross section.

36. The electric furnace as claimed in claim 2, wherein the heating member has an elliptical cross section.

37. The electric furnace as claimed in claim 3, wherein the heating member has an elliptical cross section.

38. The electric furnace as claimed in claim 4, wherein the heating member has an elliptical cross section.

39. The electric furnace as claimed in claim 5, wherein the heating member has an elliptical cross section.

40. The electric furnace as claimed in claim 6, wherein the heating member has an elliptical cross section.

* * * * *